US012660950B2

(12) United States Patent
Miller

(10) Patent No.: US 12,660,950 B2
(45) **Date of Patent: *Jun. 23, 2026**

(54) OBJECT HANGING SYSTEMS, COMPONENTS, AND RELATED METHODS

(71) Applicant: Marc William Miller, Port Ewen, NY (US)

(72) Inventor: Marc William Miller, Port Ewen, NY (US)

( * ) Notice: Subject to any disclaimer, the term of this patent is extended or adjusted under 35 U.S.C. 154(b) by 28 days.

This patent is subject to a terminal disclaimer.

(21) Appl. No.: 18/777,996

(22) Filed: Jul. 19, 2024

(65) Prior Publication Data

US 2024/0374054 A1 Nov. 14, 2024

Related U.S. Application Data

(63) Continuation of application No. 18/296,659, filed on Apr. 6, 2023, now Pat. No. 12,070,140.

(51) Int. Cl.
*A47G 1/16* (2006.01)

(52) U.S. Cl.
CPC ..... *A47G 1/1606* (2013.01)

(58) Field of Classification Search
CPC ..... A47G 1/1606
USPC ..... 248/475.1
See application file for complete search history.

(56) References Cited

U.S. PATENT DOCUMENTS 2,793,566 A * 5/1957 Burtchaell ..... A45C 15/04 248/468
6,557,311 B1 * 5/2003 Mongelli ..... E04F 19/0436 52/288.1
9,521,915 B1 * 12/2016 Tanger ..... A47G 1/1606
9,609,964 B1 * 4/2017 Munson ..... F16M 13/02
(Continued)

FOREIGN PATENT DOCUMENTS

GB 151513 A 9/1920

OTHER PUBLICATIONS

Notice of Allowance and Fee(s) Due for U.S. Appl. No. 18/296,659, dated Apr. 16, 2024, 14 pgs.
(Continued)

*Primary Examiner* — Muhammad Ijaz
(74) *Attorney, Agent, or Firm* — Matthew M. Hulihan, Esq.; Heslin Rothenberg Farley & Mesiti P.C.

(57) ABSTRACT

Systems and methods for hanging and leveling an object on a support structure including a support component and an object component. The support component includes a first mounting portion comprising a rear support surface, a channel portion positioned forwardly of the support component including a retention channel between a front support member and a rear support member, and an intermediate portion extending between the first mounting portion and the channel portion. The object component includes a second mounting portion configured to engage a surface or an alignment feature of the object, a retention portion defining a free bottom end that is configured to seat within the retention
(Continued)

channel, and a support portion defining an engagement surface. The support component and object components are configured such the retention portion can seat within the retention channel and the engagement surface engages a top end portion of the front support member.

20 Claims, 12 Drawing Sheets

(56) References Cited

U.S. PATENT DOCUMENTS

| | | | | |
|---|---|---|---|---|
| 2003/0038222 | A1* | 2/2003 | Holmes | A47G 1/1606 248/490 |
| 2007/0023595 | A1* | 2/2007 | Harmsen | A47G 1/1606 248/227.2 |
| 2009/0050775 | A1* | 2/2009 | Constantinou | A47G 1/1606 248/489 |
| 2013/0180202 | A1* | 7/2013 | Woods | A47B 95/008 52/710 |
| 2016/0045026 | A1* | 2/2016 | Trunkle | A47B 95/008 248/241 |
| 2016/0046026 | A1 | 2/2016 | Ranieri | |
| 2020/0281376 | A1* | 9/2020 | Gallien | A47G 1/0605 |
| 2023/0389728 | A1* | 12/2023 | Duran | A47G 1/205 |

OTHER PUBLICATIONS

Requirement for Election/Restriction for U.S. Appl. No. 18/296,659, dated Mar. 26, 2024, 7 pgs.

* cited by examiner

OBJECT HANGING SYSTEMS, COMPONENTS, AND RELATED METHODS

FIELD OF THE DISCLOSURE

The present disclosure generally relates to components and systems for hanging and leveling an object on a support structure. More specifically, the present disclosure provides object hanging systems that include a first component (termed herein "object component") that couples to a rear side of an object, and a second component (termed herein "support component") that couples to a front side of a support structure (e.g., a wall). The object and support components are configured to easily and securely mate with each other, in a level arrangement, in order to securely hang/mount the object on the support structure.

BACKGROUND

It is common for someone to desire to hang or mount an object, for example a framed piece of artwork, on a wall or other type of support structure. Traditionally, to hang the object on a wall, the person drives a nail or screw (or hook or similar member) into the wall such that the nail/screw protrudes from the wall, and rests a portion of the back of the object (e.g., a part of a frame of the object, or a wire or other component that is attached to or extends from the object) on the nail/screw. The person might need to undertake several attempts to reposition the item on the nail/screw before the object is hung straight and level. As an alternative, the person might attempt to drive two or more nails/screws into a wall in a level arrangement and hang the object thereon, which can help ensure that the object is oriented in a level arrangement. Another common way to hang an object is to attach a length of wire to the back of the object and to hang the wire on one or more nails or hooks driven into the wall.

SUMMARY

Traditional methods of hanging objects have drawbacks. Initially straightening/leveling the object can be difficult. Then if the object and/or wall is bumped, shaken, or otherwise moved at a later time, the object could become unleveled or shifted out of ideal position, and possible disengage from the nail/screw and fall from the wall. While an arrangement involving two or more screws/nails could help with this situation, it is relatively difficult and/or time consuming to drive two or more nails/screws into a wall in a level arrangement and at precise locations, and the plurality of nails/screws do not prevent the object from falling of the nails/screws. Alternatively, while the use of a hanging wire is potentially more secure, this configuration does not necessarily secure the object in a level arrangement, and is subject to failure if the nail, hook, screw, or other member protruding from the wall is not properly fastened to a wall.

A special consideration involves hanging objects in areas that are prone to earthquakes. Even a mild earthquake is capable of knocking a traditionally hung object, such as a piece of art or an heirloom, off a wall. While some earthquake-resistant hanging devices have been developed, these devices all require complex clips, fittings, and attachment methods, both to the wall and the object.

Still further, in each of the aforementioned configurations, the object is not oriented vertically, but rather is tilted with respect to the wall (either tilted toward or away from the wall in a direction extending from the top of the object to the bottom of the object). In other words, the object and the wall do not extend parallel to each other in the vertical direction. This is often the case when the object is hung from a point on the backside of the object near its top; the bottom of the object naturally swings toward the wall and comes to rest against the wall such that the object is tilted to face downward, even if just slightly so. Additionally, in some configurations, the object is also positioned in abutment or very close to the wall, thereby covering vents or other structures, and preventing lighting or other effects from being conveniently positioned behind the object.

Consequently, people wishing to securely hang an object, such as a framed picture or the like, in a straight and level orientation and at a precise location on a support structure (e.g., a wall) have a difficult task. There exists a need for improved object hanging systems, components and methods for hanging objects, such as frames and framed objects, without one or more of the drawbacks of the prior object hanging systems and methods. While certain aspects of conventional technologies have been discussed to facilitate disclosure of aspects herein, the Applicant in no way disclaims these technical aspects, and it is contemplated that aspects disclosed herein may encompass one or more conventional technical aspects.

Briefly, the present disclosure satisfies the need for improved object hanging and leveling components and systems. In various embodiments, the object hanging system, components, and related methods provide for quick, accurate, level, and aesthetically pleasing hanging/mounting of objects such as, but not limited to, frames and framed objects, to a support surface such as, but not limited to, a wall, partition, or other substantially vertical support member.

The present disclosure may address one or more of the problems and deficiencies of the art discussed above. However, it is contemplated that the disclosure may prove useful in addressing other problems and deficiencies in a number of technical areas. Therefore, the claimed inventions should not necessarily be construed as limited to addressing any of the particular problems or deficiencies discussed herein.

In one aspect, this disclosure provides a system for hanging an object on a support structure. The system comprises a support component configured to couple to the support structure, and an object component configured to couple to a backside of the object. The support component comprises: a first mounting portion comprising a rear support surface configured to engage a surface of the support structure; a channel portion comprising a retention channel formed between a front support member and a rear support member, the retention channel being open at an upper end; and an intermediate portion that extends between the first mounting portion and the channel portion that positions the channel portion forwardly of the first mounting portion and spaces the channel portion forwardly from the support structure when the rear support surface is engaged with the surface of the support structure and the support component is coupled to the support structure. The object component comprises: a second mounting portion configured to engage a surface or an alignment feature of the object; a retention portion defining a free bottom end and configured to seat within the retention channel of the support component; and a support portion between the second mounting portion and the retention portion, the support portion comprising an engagement surface. The support component and the object component are configured such that when the retention portion is seated within the retention channel, the engagement surface is engaged with a top end portion of the front support member such that the support component physically supports the object component.

In some embodiments, the support component and object component are configured such that when the retention portion is seated within the retention channel and the engagement surface is engaged with, and supported by, the top end portion of the front support member, the free bottom end of the retention portion is spaced from a bottom of the retention channel.

In some embodiments, the engagement surface of the support portion is a first engagement surface, and the top end portion of the front support member comprises a second engagement surface configured to engage with the first engagement surface when the retention portion is seated within the retention channel. In some such embodiments, the first engagement surface is a first downwardly sloping engagement surface, and the second engagement surface is a second downwardly sloping engagement surface. In some such embodiments, the second engagement surface is sloped downwardly toward the retention channel, and the first engagement surface is sloped to conform to the second engagement surface. In some other such embodiments, the first engagement surface is positioned on a front side of the object component.

In some embodiments, the support component and object component are configured such that when the retention portion is seated within the retention channel and the engagement surface is engaged with, and supported by, the top end portion of the front support member, a front side of the rear support member engages a rear side of the retention portion such that the engagement of the engagement surface and the top end portion of the front support member is maintained. In some embodiments, the support component further comprises an accessory portion that extends downwardly from a bottom portion of the channel portion and is spaced forwardly from a front side of the first mounting portion, the accessory portion defining a rear surface that faces the front side of the first mounting portion.

In some embodiments, a top end portion of the rear support member comprises a guide surface that is sloped downwardly toward the retention channel. In some such embodiments, the guide surface of the rear support member is a planar beveled surface.

In some embodiments, the object component further comprises a front alignment projection that extends forwardly from a front side of the object component and is configured to engage the alignment feature of the object.

In some embodiments, the retention portion is positioned rearwardly of the second mounting portion. In some embodiments, the retention portion extends laterally and is substantially planar, and the retention channel extends laterally and is substantially planar.

In some embodiments, the second mounting portion comprises a front support surface that extends laterally and is substantially planar, and the rear support surface extends laterally and is substantially planar. In some embodiments, the first mounting portion further comprises a plurality of mounting apertures extending therethrough between the rear support surface and a front side of the first mounting portion. In some embodiments, the second mounting portion further comprises a plurality of mounting apertures extending therethrough between a front support surface and a rear surface of the second mounting portion. In some embodiments, the second mounting portion comprises a planar front support surface configured to engage the surface of the object.

In another aspect, this disclosure provides a method of hanging an object on a support structure that comprises comprising obtaining an object hanging system comprising a support component and an object component. The support component comprises: a first mounting portion comprising a rear support surface; a channel portion comprising a retention channel formed between a front support member and a rear support member, the retention channel being open at an upper end; and an intermediate portion that extends between the first mounting portion and the channel portion that positions the channel portion forwardly of the first mounting portion. The object component comprises: a second mounting portion; a retention portion defining a free bottom end; and a support portion between the second mounting portion and the retention portion, the support portion comprising an engagement surface. The method further comprises affixing the first mounting portion to the support structure with the rear support surface in engagement with a surface of the support structure such that the channel portion is positioned forwardly of the surface of the support structure. The method also comprises affixing the second mounting portion to the object with a front support surface of the second mounting portion aligned and engaged with a surface or an alignment feature of the object. The method further comprises positioning the retention portion within the retention channel and engaging the engagement surface with a top end portion of the front support member such that the support component physical supports the object component and, thereby, the object is supported by the support structure.

In some embodiments, the affixing the second mounting portion to the object comprises engaging the front surface with a back surface or an edge of the alignment feature of the object. In some embodiments, the object is a frame or framed object.

Certain embodiments of the presently-disclosed object hanging system, components and related methods have several features, no single one of which is solely responsible for their desirable attributes. Without limiting the scope of the object hanging system, components and related methods as defined by the claims that follow, their more prominent features will now be discussed briefly. After considering this discussion, and particularly after reading the section of this specification entitled "Detailed Description," one will understand how the features of the various embodiments disclosed herein provide a number of advantages over the current state of the art. For example, in some embodiments, the object hanging system, components and related methods provide for secure mounting or hanging of objects, such as frames and framed objects, onto a mounting surface. As another example, the object hanging system, components and related methods provide for mounting or hanging of objects, such as frames and framed objects, onto a mounting surface such that the frame/object is positioned proud of the mounting surface, which allows for a more aesthetically pleasing presentation and useful space behind the frame/object (such as for lighting or other effects, for example). As yet another example, the object hanging system, components and related methods provide for quick, accurate and secure level mounting/hanging of objects, such as a frames and framed objects, onto a mounting surface.

It should be appreciated that all combinations of the foregoing aspects and additional concepts discussed in greater detail below (provided such concepts are not mutually inconsistent) are contemplated as being part of the inventive subject matter and to achieve the advantages disclosed herein. In particular, all combinations of disclosed and/or claimed subject matter appearing at the end of this disclosure are contemplated as being part of the inventive subject matter disclosed herein.

These and other objects, features and advantages of this disclosure will become apparent from the following detailed description of the various aspects of the disclosure taken in conjunction with the accompanying drawings.

Additional features and advantages are realized through the concepts described herein.

BRIEF DESCRIPTION OF THE DRAWINGS

Aspects described herein are particularly pointed out and distinctly claimed as examples in the claims at the conclusion of the specification. The foregoing and other objects, features, and advantages of the disclosure are apparent from the following detailed description taken in conjunction with the accompanying drawings in which:

DETAILED DESCRIPTION

Figure 1:
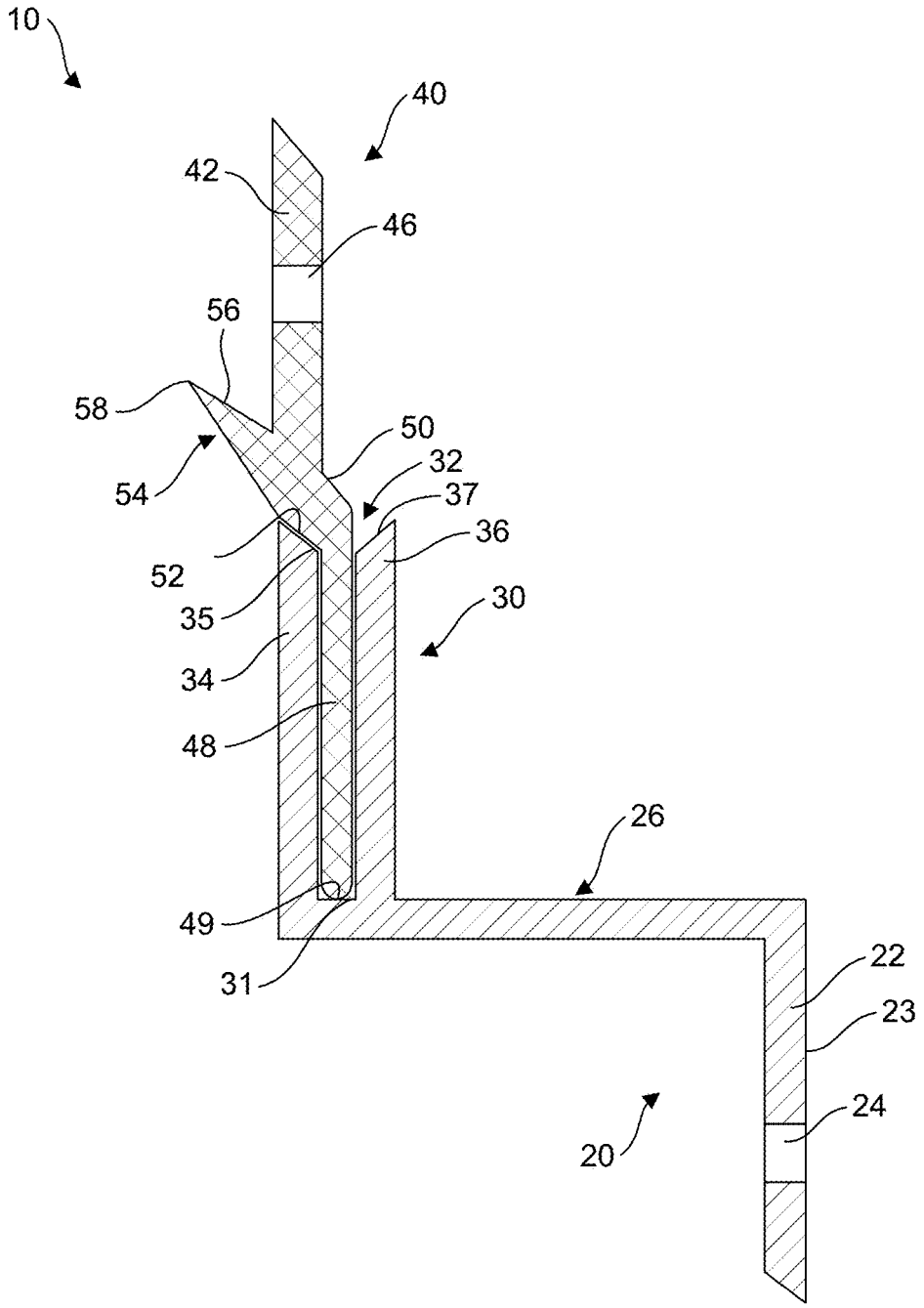
FIG. 1 is a side cross-sectional view of an object hanging system with an object component and a support component in a fully engaged arrangement in accordance with one or more aspects of the present disclosure.

Aspects of the present disclosure and certain examples, features, advantages, and details thereof are explained more fully below with reference to the non-limiting examples illustrated in the accompanying drawings. Descriptions of well-known materials, fabrication tools, processing techniques, etc., are omitted so as not to unnecessarily obscure the relevant details. It should be understood, however, that the detailed description and the specific examples, while indicating aspects of the disclosure, are given by way of illustration only, and are not by way of limitation. Various substitutions, modifications, additions, and/or arrangements, within the spirit and/or scope of the underlying inventive concepts will be apparent to those skilled in the art from this disclosure.

Approximating language, as used herein throughout disclosure, may be applied to modify any quantitative representation that could permissibly vary without resulting in a change in the basic function to which it is related. Accordingly, a value modified by a term or terms, such as "about" or "substantially," is not limited to the precise value specified. For example, these terms can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%. In some instances, the approximating language may correspond to the precision of an instrument for measuring the value.

Terminology used herein is for the purpose of describing particular examples only and is not intended to be limiting. As used herein, the singular forms "a", "an" and "the" are intended to include the plural forms as well, unless the context clearly indicates otherwise. Furthermore, references to "one example" are not intended to be interpreted as excluding the existence of additional examples that also incorporate the recited features. Moreover, unless explicitly stated to the contrary, the terms "comprising" (and any form of "comprise," such as "comprises" and "comprising"), "have" (and any form of "have," such as "has" and "having"), "include" (and any form of "include," such as "includes" and "including"), and "contain" (and any form of "contain," such as "contains" and "containing") are used as open-ended linking verbs. As a result, any examples that "comprises," "has," "includes" or "contains" one or more step or element possesses such one or more step or element, but is not limited to possessing only such one or more step or element. As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable or suitable. For example, in some circumstances, an event or capacity can be expected, while in other circumstances the event or capacity cannot occur—this distinction is captured by the terms "may" and "may be."

An exemplary embodiment of an object hanging, supporting, or coupling system according to the present disclosure is illustrated in FIGS. 1-4, and referenced generally by reference numeral 10. In various embodiments, the object hanging system 10 advantageously provides for secure level hanging of objects 100 (see, e.g., FIG. 2) on a support surface/structure 102 (see, e.g., FIG. 2), and that may become unintentionally disengaged therefrom. The object hanging system 10 is advantageously intuitive and easy to use. It also spaces the object 100 from the support surface 102, thereby advantageously providing an aesthetically pleasing appearance of the object 100, and allowing structures or devices, for example lighting, audio, and/or any other type of devices or objects, to be positioned behind the object 100.

Figure 2:
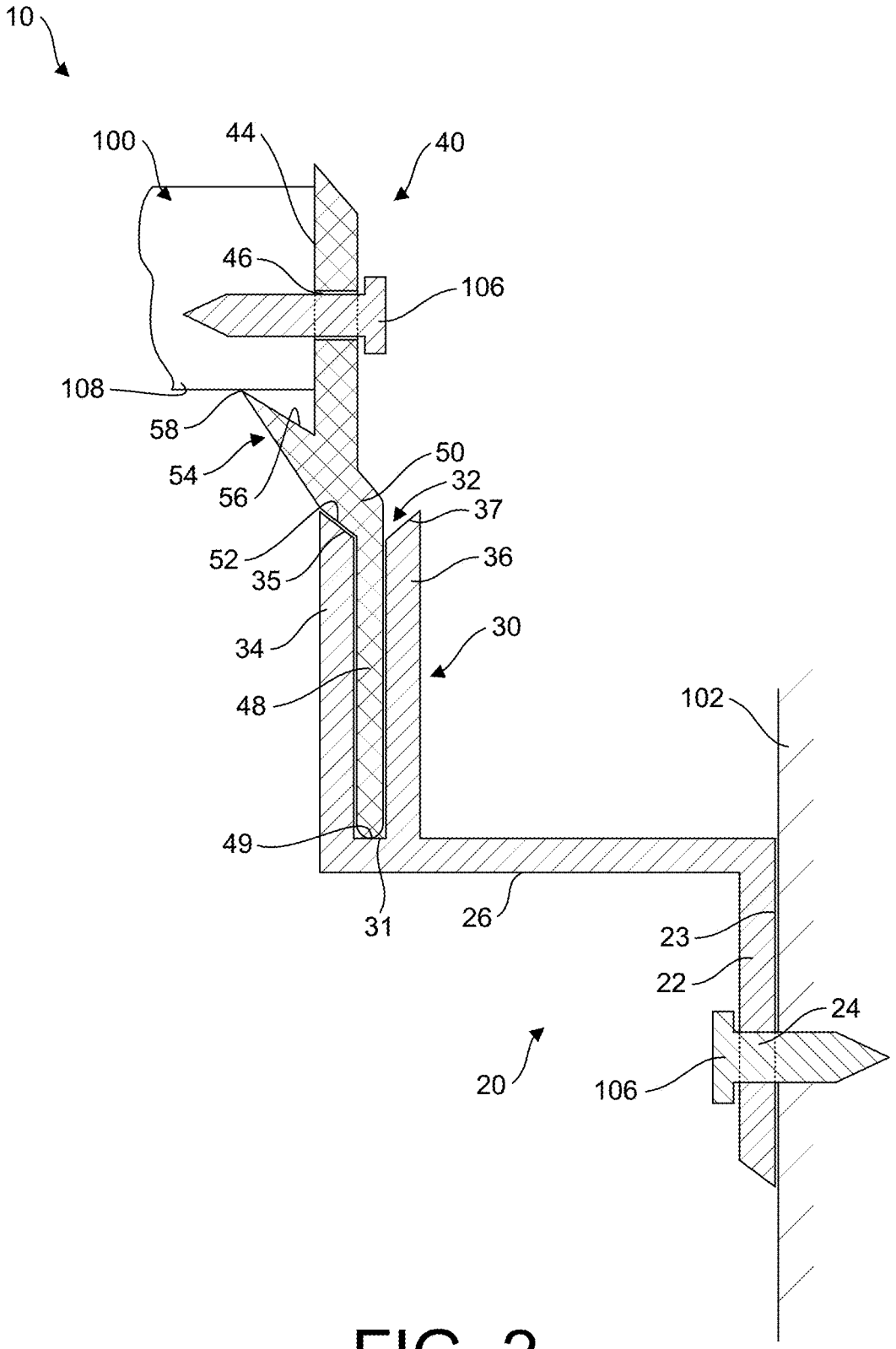
FIG. 2 is side cross-sectional view of the object hanging system of FIG. 1 hanging a framed object on a support structure in accordance with one or more aspects of the present disclosure.

It is noted that the support surface/structure 102, as shown in FIG. 2 (and in FIG. 19), may be any structure that defines any surface which is able to physically support the object 100 and the system 10 in an elevated position above a ground or ground surface. Most commonly, the support surface/structure 102 may be a wall structure with an outer surface to which the object is to be mounted, but the support structure 102 may equally be a pedestal or post structure or any other structure that extends upwardly or is otherwise elevated from a ground or ground surface. The outer surface of the support structure 102 may typically be substantially flat or planar, and vertically oriented. However, it is noted that the outer surface of the support structure 102 may be convex/concave, irregular, or otherwise non-planar, and be in any orientation, whether true vertical or not. In some embodiments, the support structure or surface 102 may be any structure or surface to which a support component 20 of the system 10 is able to be secured, as explained further below.

It is further noted that the object 100, as shown in FIG. 2 (and in FIGS. 11 and 12), may be any object that a user wishes to hang on or couple to the support structure 102 in an elevated position (i.e., off the ground or a ground surface). In a common scenario, the object 100 is a frame or framed object, but it need not necessarily include a frame structure. In one embodiment, the object 100 is framed art, décor, memorabilia, or credentials. The object 100 may have a back or rear side configuration that substantially matches a front side of the support structure 102. For instance, in the case of a framed painting, the painting is generally planar and is to be hung on a wall that is generally planar. However, it may be the case that the rear side of the object 100 is shaped or configured differently than the front side of the front side of the support structure 102, as explained further below. In some embodiments, the object 100 may be any object, component, item, device, or structure to which an object component 40 of the system 10 is able to be secured, as explained further below. In some such embodiments, the object 100 may be any object to which the object component 40 can be coupled with a front alignment projection 54 of the object component 40 in engagement with a horizontal alignment or reference feature 108 (see FIG. 11, FIG. 12) of the object 100, as explained further below.

In some embodiments, the object hanging system 10 includes an exemplary object component 40 as shown in FIGS. 1-12 that is configured to couple to/with the object 100, and an exemplary support component 20 as shown in FIGS. 1-4 and 13-19 that is configured to couple to/with the support structure 102. The object component 40 may be configured to couple to/with a rear or back side or surface of the object 100, and the support component 20 may be configured to couple to/with a front side or surface of the support structure 102. In some embodiments, the system 10 is a two-piece construct that includes the object component 40 and the support component 20 as the only components thereof. Fastening members, as discussed below, may also be provided and/or utilized to couple/attach the object component 40 to an object 100 to be hung, and/or to couple/attach the support component 20 to a support structure or surface 102.

In some embodiments, the object component 40 and/or the support component 20 may be of one-piece construction (e.g., integral), such as being monolithic. In some other embodiments, the object component 40 and/or the support component 20 may be formed of separate components that are coupled together to form the respective member. In some embodiments, the object component 40 and/or the support component 20 may be formed of at least one plastic material and/or at least one metal material, although other relatively stiff and strong materials may also be utilized.

It is noted that the weight and/or size of a particular object 100 to be hung via the system 100 may dictate a necessary or corresponding material and/or size (e.g., thicknesses (e.g., in the front to back direction), lateral lengths, widths (front to back) and heights) of the object component 40 and/or the support component 20. It is also noted that the system 10, and thus the object component 40 and/or the support component 20 thereof, may be of any size, such as any total lateral width (e.g., in the horizontal direction), and/or any total width (front to back; extending away from a support surface), and/or any height (e.g., in the vertical direction). Further, a system 10 may comprise a kit of one or more of the object components 40 and/or one or more of the support component 20, such as a plurality of pairs of object components 40 and support components 20 (of the same sizes or of differing sizes), for example.

Figure 7:
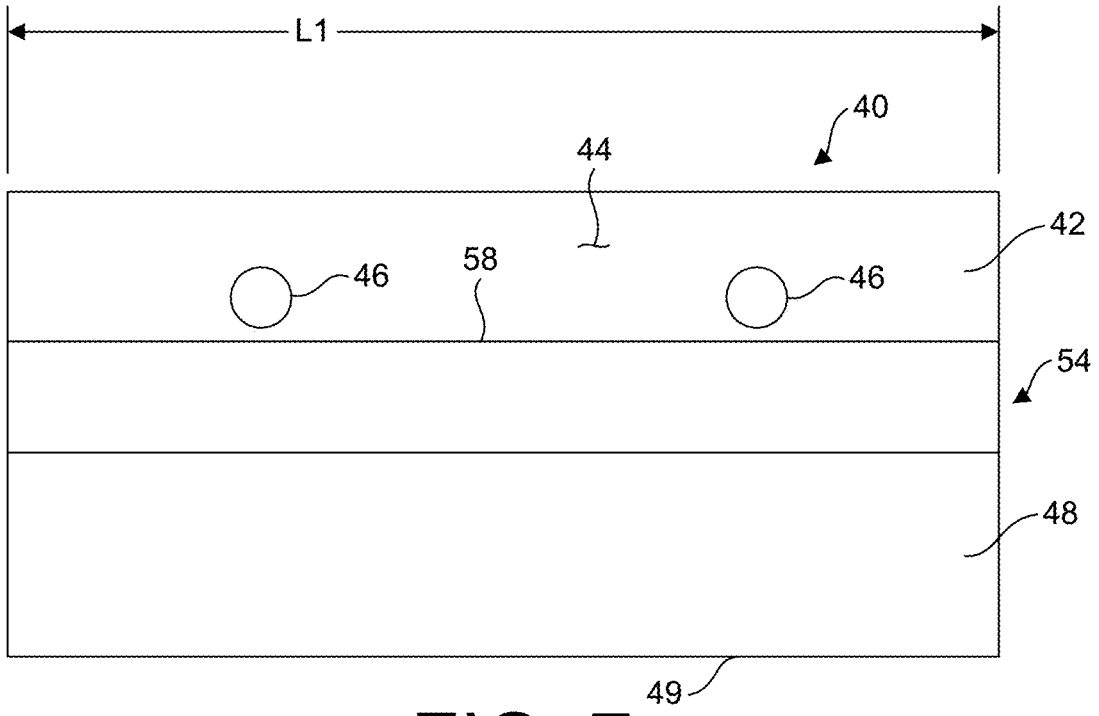
FIG. 7 is a front view of the object component of FIG. 4 in accordance with one or more aspects of the present disclosure.
Figure 8:
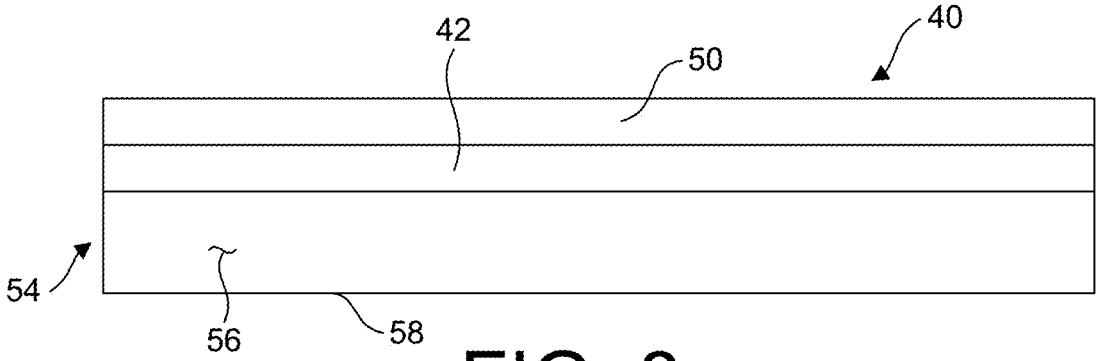
FIG. 8 is a top plan view of the object component of FIG. 4 in accordance with one or more aspects of the present disclosure.
Figure 9:
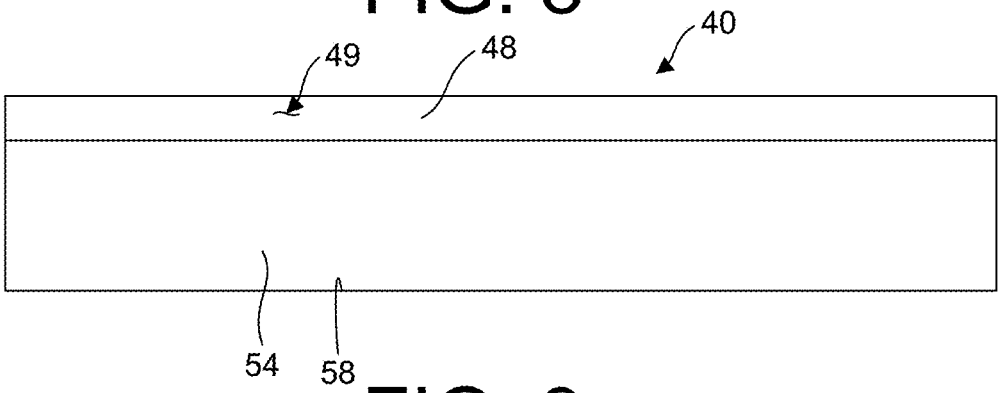
FIG. 9 is a bottom plan view of the object component of FIG. 4 in accordance with one or more aspects of the present disclosure.
Figure 15:
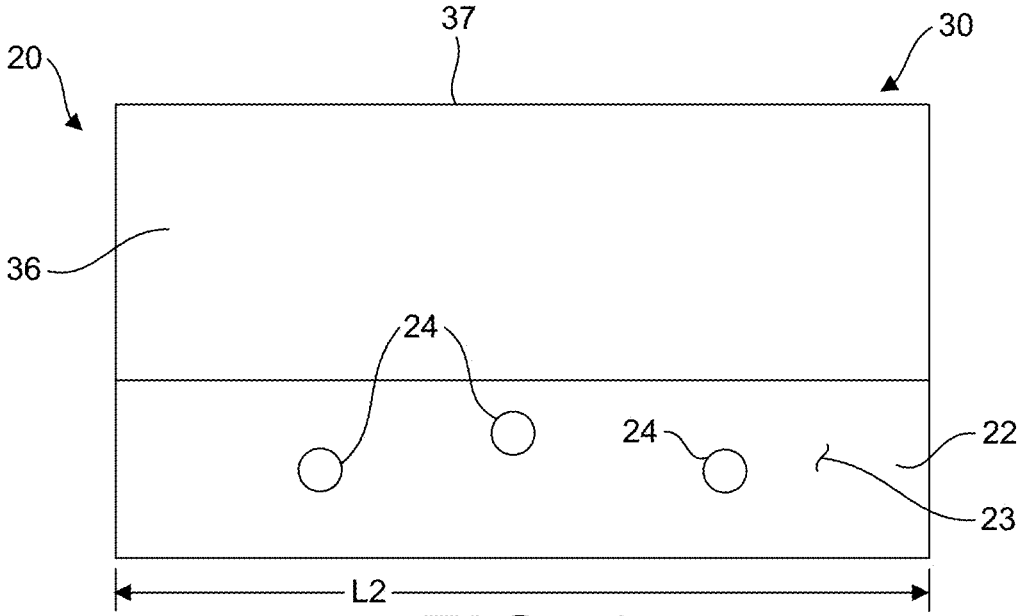
FIG. 15 is a rear view of the support component of FIG. 13 in accordance with one or more aspects of the present disclosure.
Figure 16:
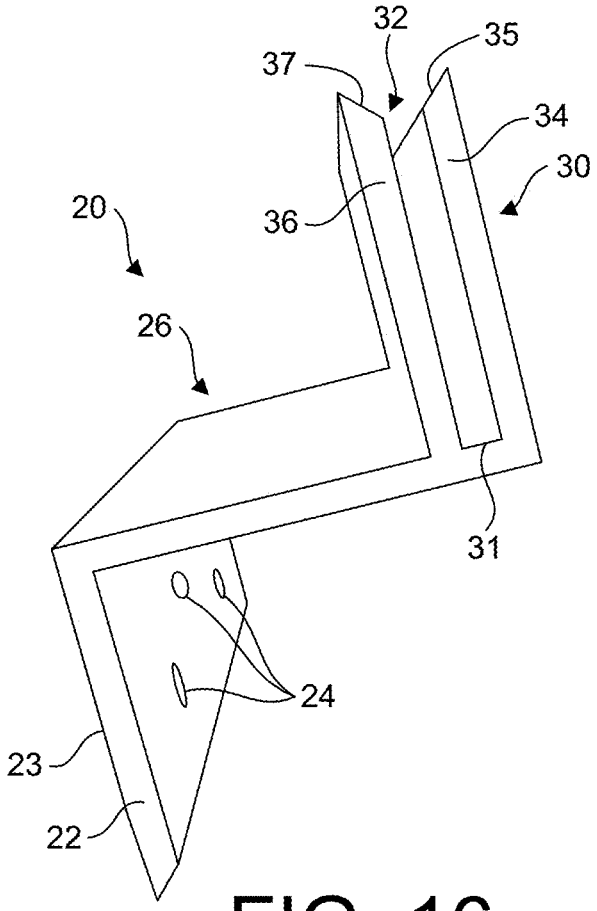
FIG. 16 is a side perspective view of the support component of FIG. 13 in accordance with one or more aspects of the present disclosure.
Figure 17:
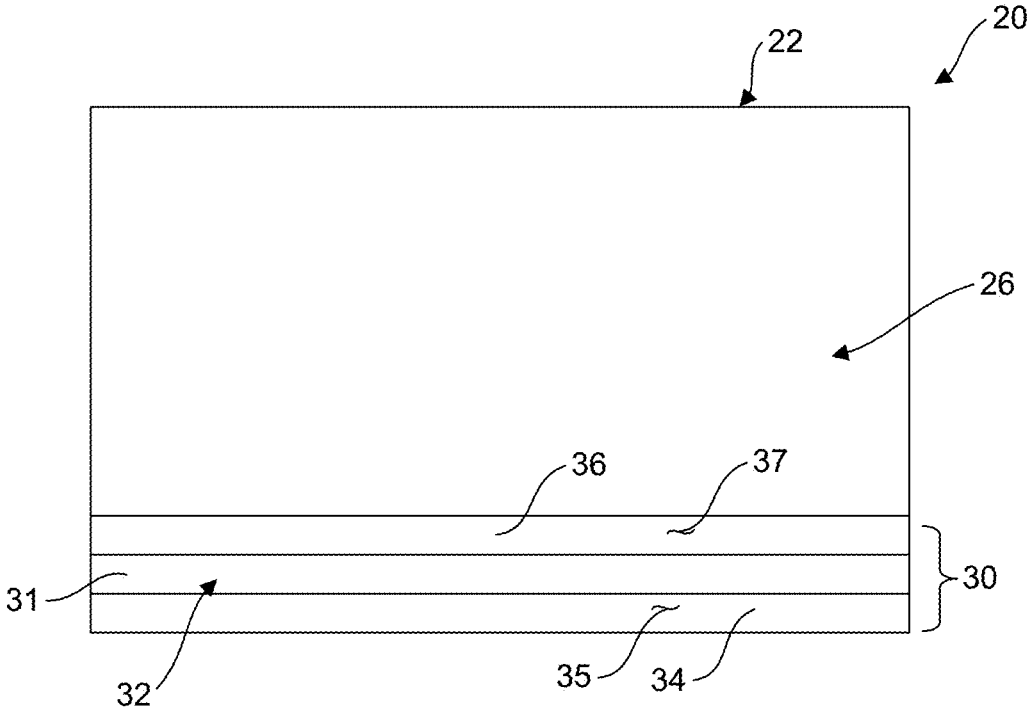
FIG. 17 is a top plan view of the support component of FIG. 13 in accordance with one or more aspects of the present disclosure.
Figure 18:
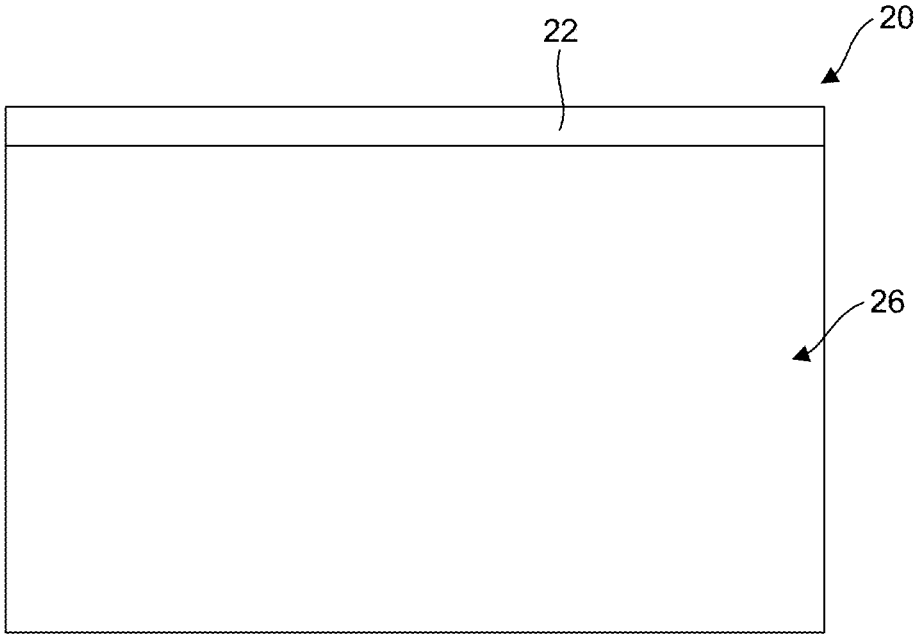
FIG. 18 is a bottom plan view of the support component of FIG. 13 in accordance with one or more aspects of the present disclosure.

The object component 40 has a total lateral length referenced herein as L1, as shown in FIG. 7, and the support component 20 has a total lateral length referenced herein as L2, as shown in FIG. 15. In some embodiments, L1 and/or L1 is/are at least 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, or 6.0 inches. In some embodiments, the object component 40 and the support component 20 may define substantially the same total lateral lengths, i.e. L1 and L2 are equal. In some other embodiments, the object component 40 may define a total lateral length L1 that is less than (or greater than) the total lateral length L2 defined by the support component 20.

Figure 10:
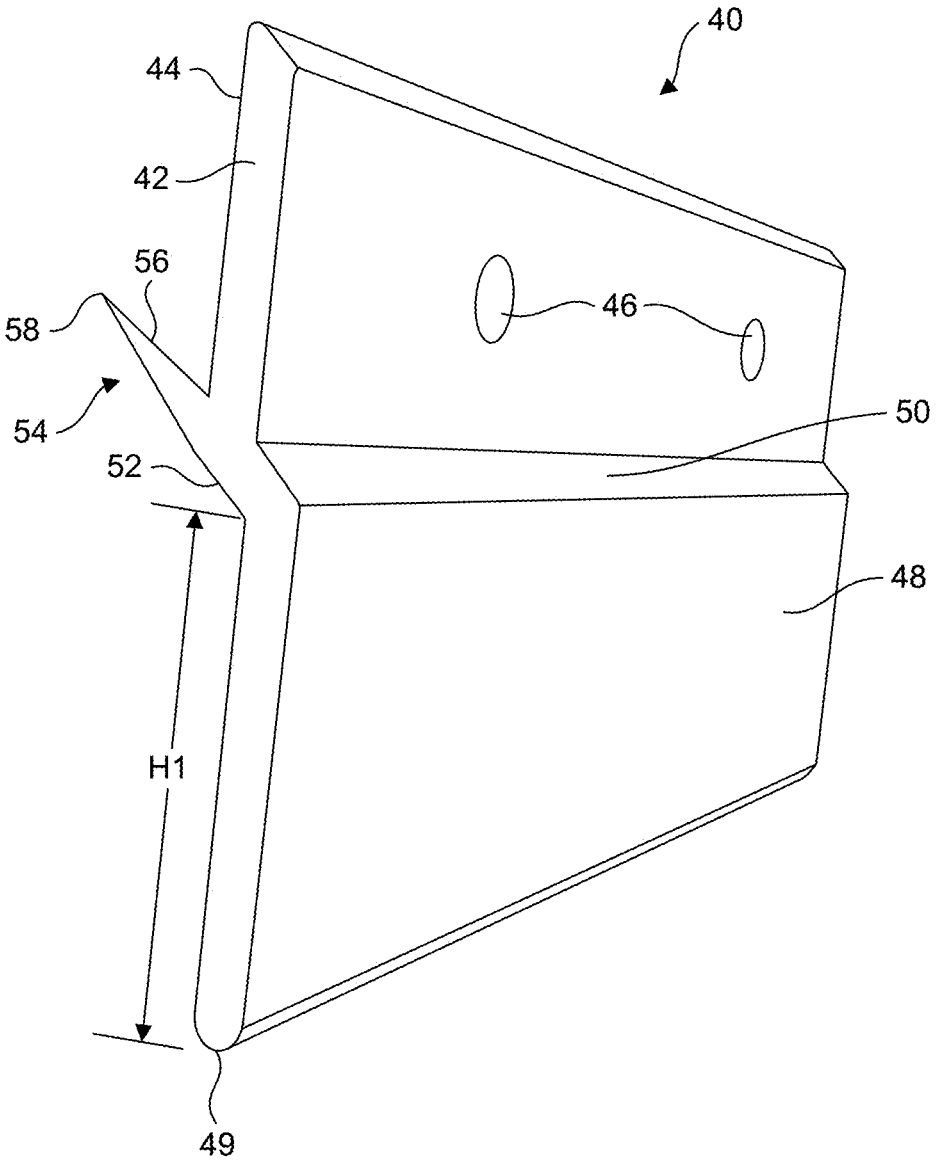
FIG. 10 is a rear side perspective view of the object component of FIG. 4 in accordance with one or more aspects of the present disclosure.
Figure 11:
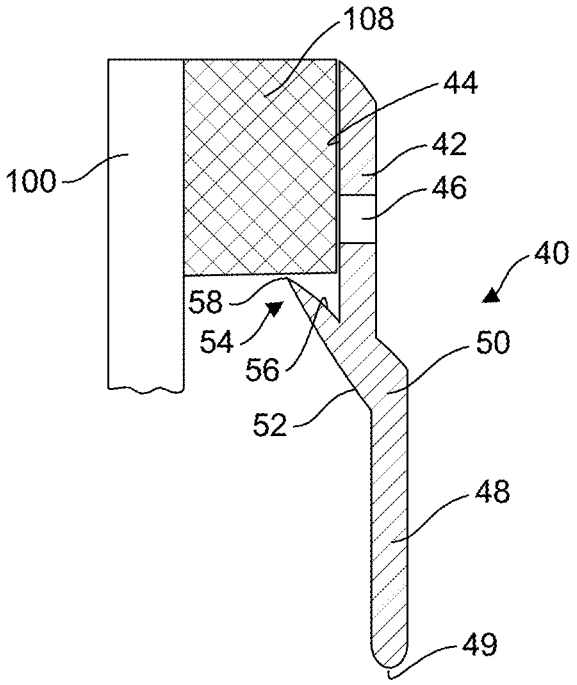
FIG. 11 is a side cross-sectional view of the object component of FIG. 4 supporting an object in accordance with one or more aspects of the present disclosure.
Figure 12:
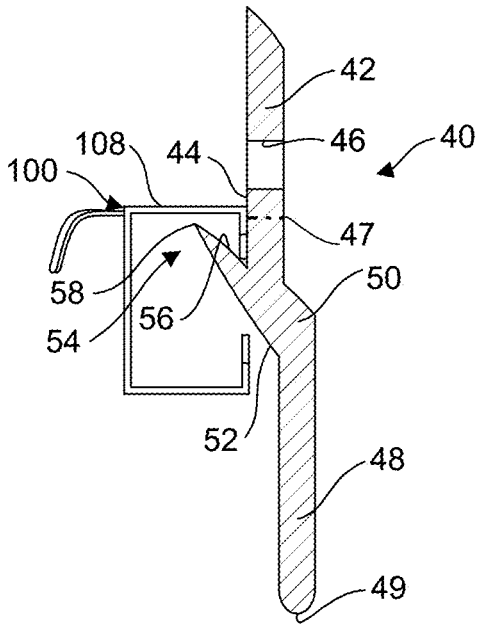
FIG. 12 is a side cross-sectional view of the object component of FIG. 4 supporting a framed object in accordance with one or more aspects of the present disclosure.

As shown in FIGS. 1-12, in some embodiments, the exemplary object component 40 may include a mounting portion 42 that is configured to engage/abut a surface of the object 100, such as, but not limited to, a back/rear side or surface of the object 100. In some embodiments, the mounting portion 42 may include or define a front (front-facing) mounting or support side or surface 44 that is configured to engage a corresponding rear (rearwardly facing) mounting surface or side portion of the object 100, as shown in FIGS. 2, 11 and 12. In the illustrated exemplary embodiment, the support surface 44 of the mounting portion 42 is substantially planar. In some other embodiments (not shown), the support surface 44 of the mounting portion 42 may be non-planar.

As shown in shown FIGS. 1-7 & 10-12, the mounting portion 42 may include a plurality of (e.g., two) mounting apertures 46 extending through mounting portion 42 from the support surface 44 to an opposing surface of the mounting portion 42, such as a rearwardly facing surface 45 (see FIG. 5) of the mounting portion 42. The plurality of mounting apertures 46 may be located at differing locations along the lateral length of the mounting portion 42, and be located at differing heights. The mounting apertures 46 may be configured to allow a fastening or fixation member 106 (see FIG. 2), such as, but not limited to, a nail or screw, to pass therethrough and into the object 100 positioned at or adjacent to the support surface 44 to couple the mounting portion 42 (and thereby the object component 40 itself) and the object 100 together, as shown in shown FIGS. 1 & 11. In some other embodiments (not shown), mounting portion 42 may be coupled to an object 100 via a fastening mechanism other than at least one fastening member 106 extending through a mounting aperture 46, such as via a touch fastener or an adhesive, for example, at the support surface 44. In yet another embodiment, an object 100 may not be coupled to the mounting portion 42, such as to the support surface 44, via a fastening or coupling mechanism, but rather may be retained on a front alignment projection 54 of the object component itself via gravity. A configuration in which a mating portion of the object 100 and the alignment projection 54 engages to support the object is shown by the embodiments of FIGS. 11 and 12, which lack a fastening member 106 (and can potentially lack the mounting aperture (s) 46), as is described in further detail below.

As shown in FIGS. 1-12, the mounting portion 42 may form a top portion of the object component 40, and define a free top end of the object component 40 along the height (vertical) direction. As also shown in FIGS. 1-12, in some embodiments the object component 40 may include a retention portion 48 that forms a bottom portion of the object component 40 along the height direction, which defines a free bottom end 49. In some embodiments, the bottom end 49 may be rounded or pointed.

Figure 13:
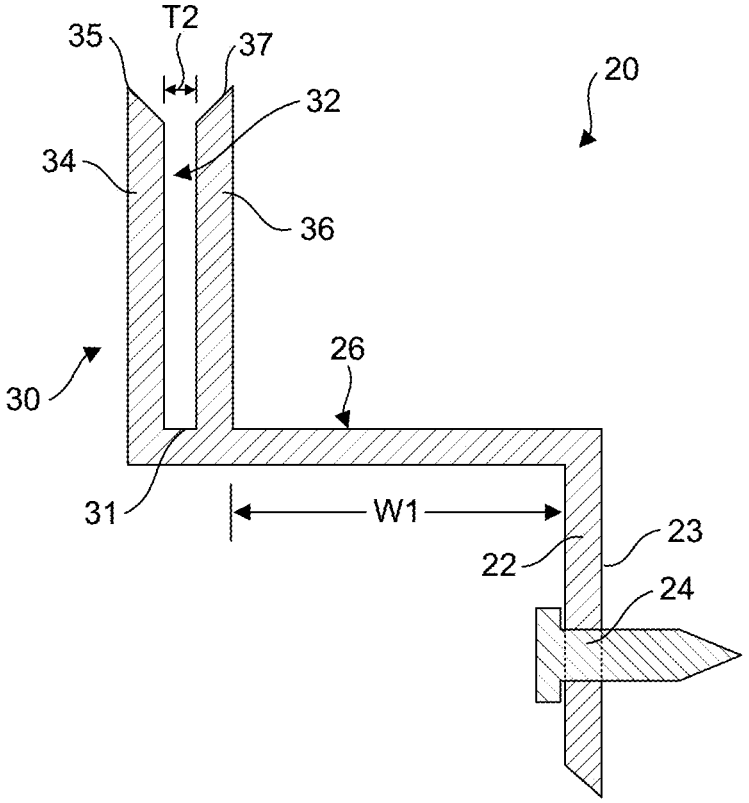
FIG. 13 is a side cross-sectional view of the support component of FIG. 1 as indicated in FIG. 14 in accordance with one or more aspects of the present disclosure.
Figure 14:
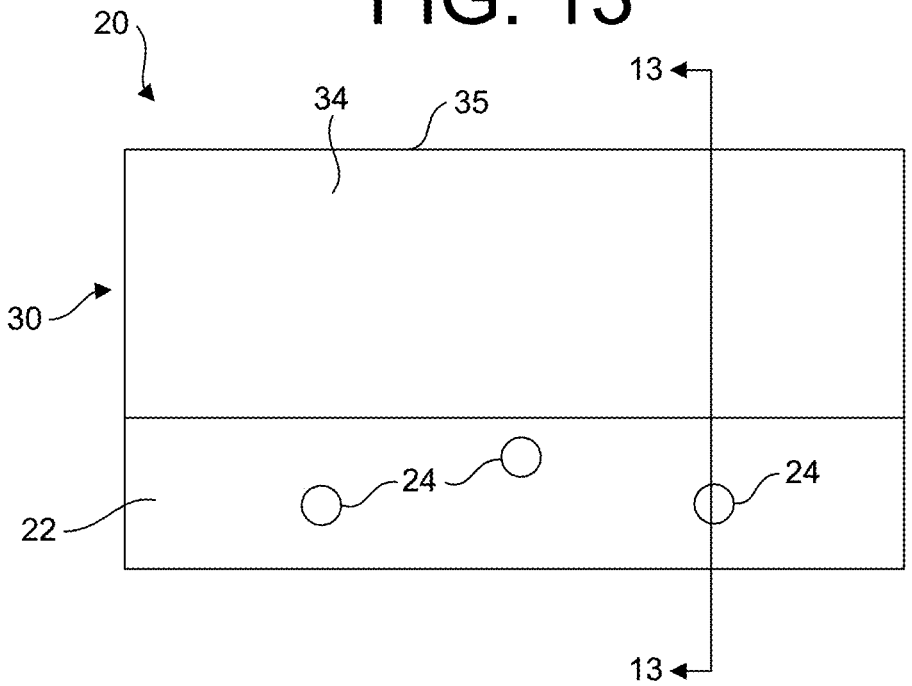
FIG. 14 is a front view of the support component of FIG. 13 in accordance with one or more aspects of the present disclosure.

The retention portion 48 is configured to extend into and seat within a retention channel 32 of the support component 20, as described further below. In some embodiments, the retention portion 48 may extend linearly (e.g., be planar) in the height and/or lateral length directions, such as to define opposing planar side surfaces in the width (front to back direction). In some embodiments, the retention portion 48 (and potentially the retention channel 32) is substantially planar and laterally extended or elongated. In some embodiments, the total width or thickness T1 of the retention portion 48 in the front to back direction (as shown in FIG. 5) may be substantially the same or slightly less than (e.g., no more than 1%, 2%, 3%, 4%, 5%, 6%, 7% 8%, 9%, 10%, 15%, 20% or 25% less than, for example) the thickness T2 of the retention channel 32 (as shown in FIG. 13), such that the retention portion 48 may insert into and cooperate with the retention channel 32, as shown in FIGS. 1-4, to prevent or impede forward, backward, and downward movement of the object component 40 (and therefore the object mounted thereto) relative to the support component 20 when in operative engagement with each other as explained herein.

Thickness T1 of retention portion 48 may be any desired thickness, as can a thickness T3 of mounting portion 42, i.e., the thickness extending from front mounting/support surface 44 to the opposing, rearwardly facing surface 45 (see FIG. 5) of the mounting portion 42. Further, these two thicknesses, T1 and T2, can be the same or different. T1 could be equal to, less than, or greater than, thickness T3, as the Figures presented herewith may not necessarily be drawn to scale.

Figure 3:
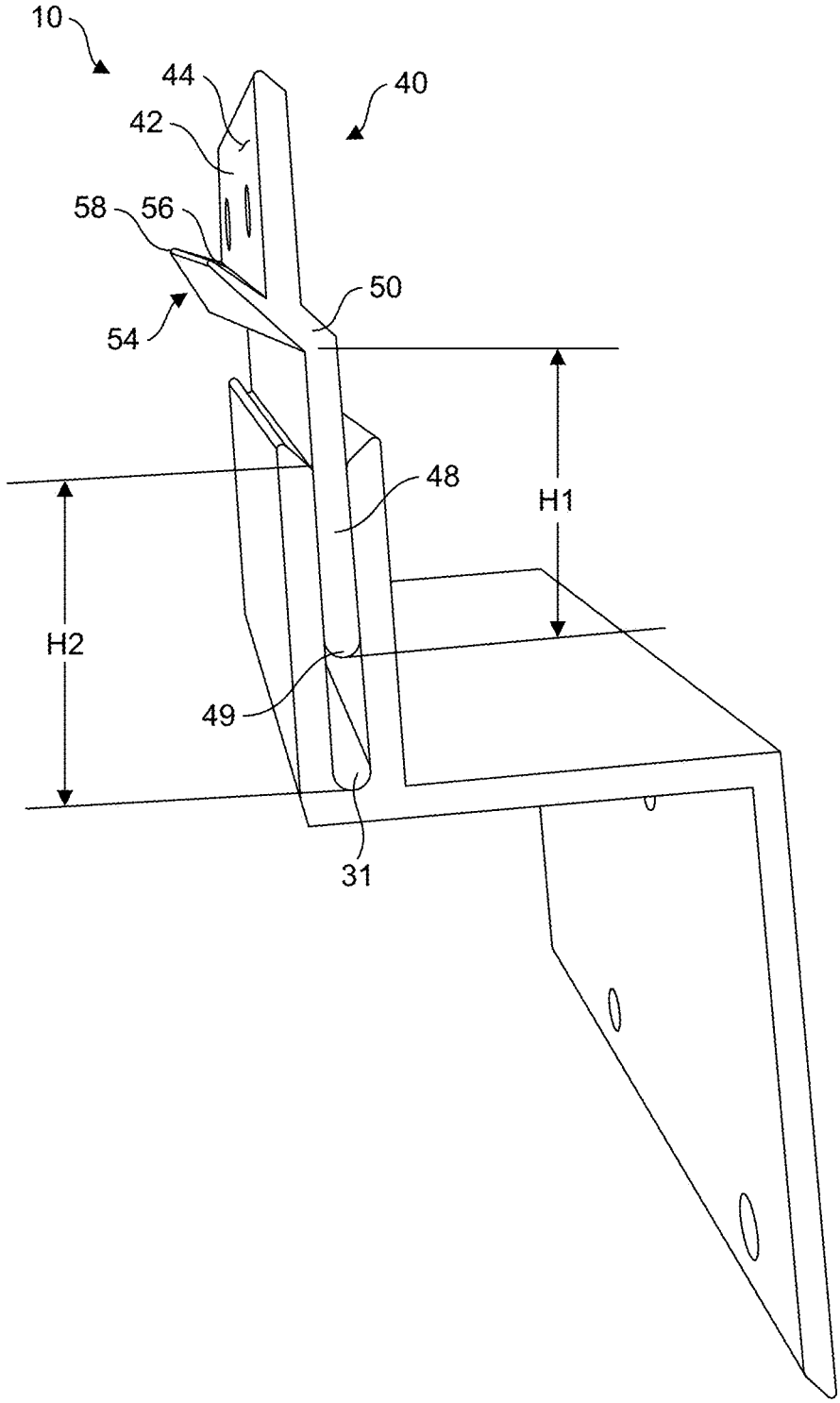
FIG. 3 is a side perspective view of the object hanging system of FIG. 1 in a partially engaged arrangement in accordance with one or more aspects of the present disclosure.
Figure 5:
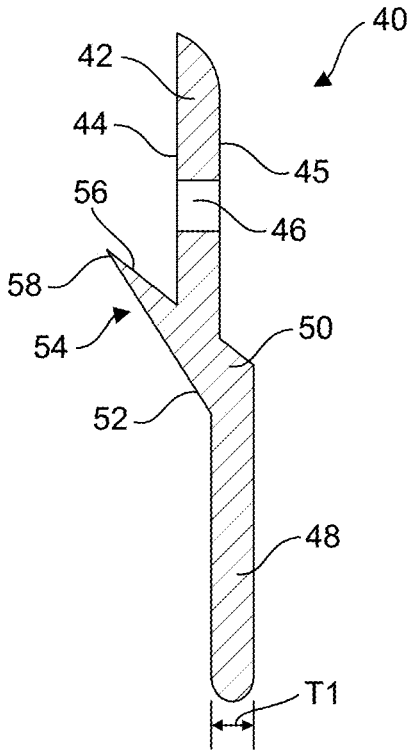
FIG. 5 is a side cross-sectional view of the object component of FIG. 4 as indicated in FIG. 6 in accordance with one or more aspects of the present disclosure.
Figure 6:
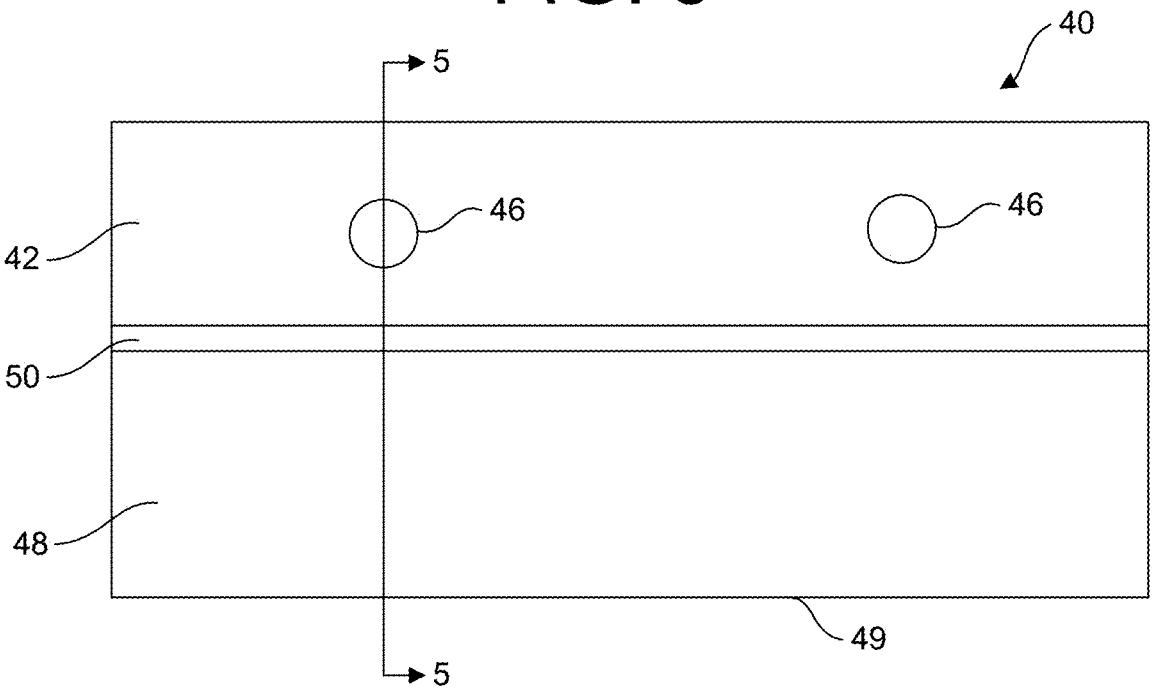
FIG. 6 is a rear view of the object component of FIG. 4 in accordance with one or more aspects of the present disclosure.

The total height H1 of the retention portion 48 from the bottom end 49, as shown in FIG. 5, may also be related to that of the retention channel 32. For example, as shown in FIGS. 3 and 10, the total height H1 (see FIG. 10) of the retention portion 48 may be about the same or less than (e.g., no more than 1%, 2%, 3%, 4%, 5%, 6%, 7% 8%, 9%, 10%, 15%, 20%, 25%, 30%, 35%, 40%, 45% or 50% less than, for example) the total height H2 (see FIG. 3, 19) of the retention channel 32. In this way, in some embodiments, the support component 20 and the object component 40 may be configured such that when the retention portion 48 is fully seated within the retention channel 32, the bottom end 49 is spaced from the channel bottom 31 of the retention channel 32. In some other embodiments, the support component 20 and the object component 40 may be configured such that when the retention portion 48 is fully seated within the retention channel 32, the bottom end 49 engages the channel bottom 31 of the retention channel 32 (see FIGS. 1, 2).

In some embodiments, as shown in FIGS. 1-12, the retention portion 48 is positionally offset from the mounting portion 42 along the width (front-back/rear) direction. For example, the retention portion 48 may be positioned rearwardly of the mounting portion 42 (see FIG. 4), and therefore positioned closer to the support surface 1 (see FIG. 2). In such an arrangement, the retention portion 48 may be rearwardly spaced from the object 100 (e.g., the back side thereof), so that the object 100 does not interfere with the insertion and retention of the retention portion 48 within the retention channel 32.

As shown in FIGS. 1-12, the object component 40 may further include a support portion 50 between the mounting portion 40 and the retention portion 48 including or defining a downwardly sloping engagement surface 52. Positioned at the front side of the object component 40, the engagement surface 52 may extend rearwardly (toward the retention portion) as it extends downwardly, as shown in FIGS. 1-12. In some embodiments, the engagement surface 52 may be planar. In some embodiments, the engagement surface 52 may be an inclined plane.

The configuration of the engagement surface 52 (and the retention portion 48 generally) may be related to that of the retention channel 32. As shown in FIGS. 1-2, the support component 20 and the object component 40 may be configured such that when the retention portion 48 is fully seated within the retention channel 32, the engagement surface 52 is engaged with a top end portion of a support member (such as a front support member 34 such that the support component 20 physically supports the object component 40. Accordingly, the engagement surface 52 and the top end portion of a support member may be configured as securely mating surfaces that carry/pass the load (at least partially) of the object 100 therethrough to support component 20 and, ultimately, to the support structure 102.

Figure 4:
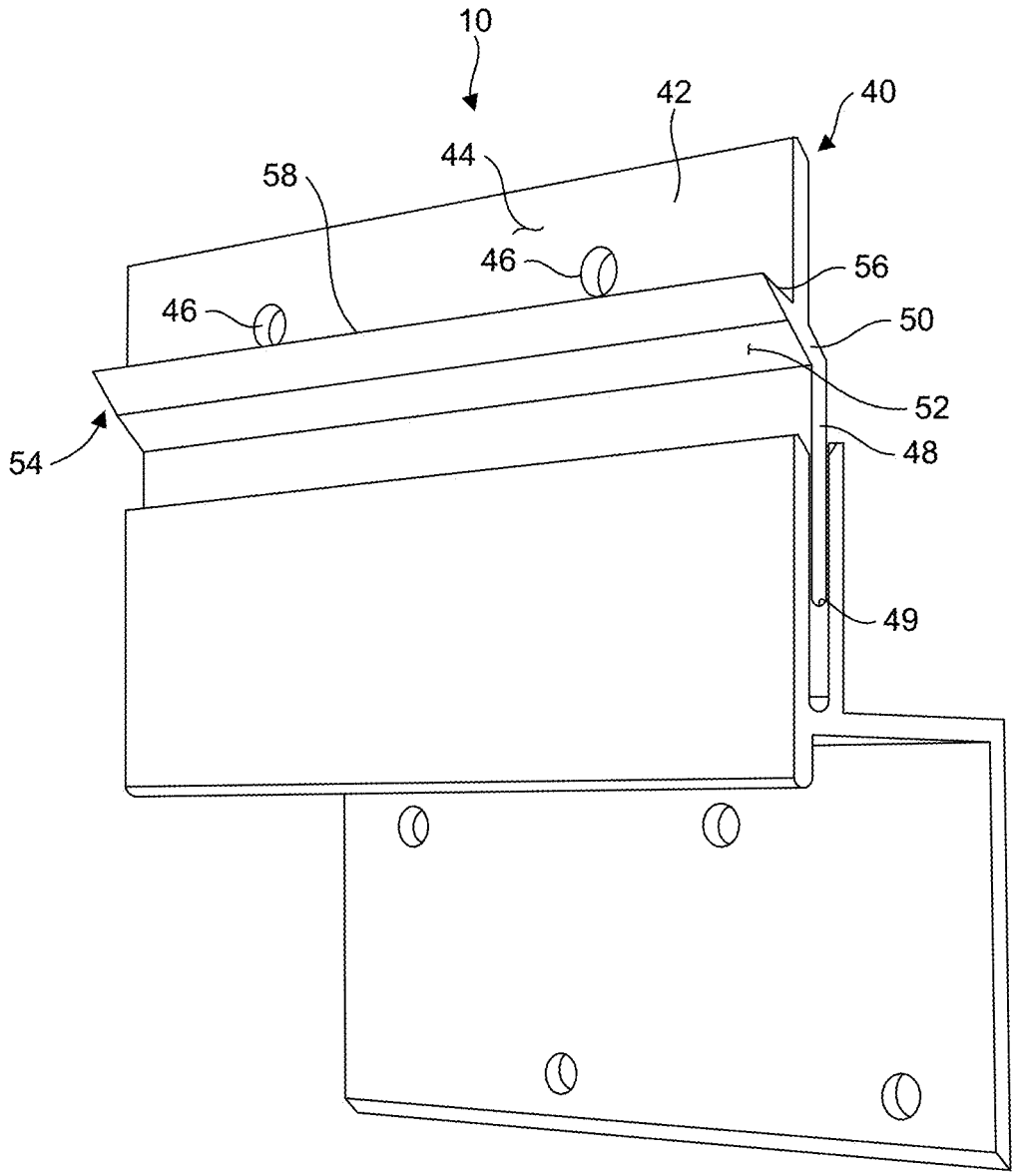
FIG. 4 is a front perspective view of the object hanging system of FIG. 1 in a partially engaged arrangement in accordance with one or more aspects of the present disclosure.

With reference to FIGS. 1-12, the object component 40 may also include front alignment projection 54 extending forwardly from a front side of the object component 40, and laterally along the object component (see FIG. 4). The alignment projection 54 is configured to engage an alignment feature of the object 100, as shown in FIGS. 11 and 12. In some embodiments, a bottom side or surface of the alignment projection 54 is contiguous with the engagement surface 52 of the support portion 50, as shown in FIG. 5. As also shown in FIG. 5, the alignment projection 54 may extend forwardly and upwardly, such as for example at an angle or slope. For example, a top object engagement surface 56 of the alignment projection 54 may extend forwardly and upwardly, such as extending upwardly as it extends forwardly. However, it is noted that the alignment projection 54 may otherwise extend forwardly and upwardly. It is further noted that alignment projection 54 could protrude to a greater or lesser extent/distance from relative to surface 44 and mounting portion 42 than depicted in the Figures. In some embodiments, projection 54 is omitted entirely. Further, a thickness (vertical height) of the projection 54 at a base thereof where the projection 54 meets surface 44 of potion 42 could be greater or lesser than depicted.

The top object engagement surface 56 of the front alignment projection 54 may be configured to engage a portion of the object 100 to align the object component 40 with the object 100, and/or physically support (at least partially) the object. In some embodiments, top object engagement surface 56 may include a pointed tip edge 58 at the forward end of the top object engagement surface 56, which may define the free end of the alignment projection 54. In some embodiments, the top object engagement surface 56 is planar.

The alignment projection 54 is configured such that when the top object engagement surface 56 (and pointed tip edge 58) of the front alignment projection 54 is oriented horizontally with respect to a lateral direction (i.e., does not extend in the height direction as it extends laterally), the engagement surface 52 is oriented horizontally in the lateral direction (i.e., does not extend in the height direction as it extends laterally). Accordingly, when the object engagement surface 56 of the front alignment projection 54 is in engagement/abutment with a lateral reference portion (horizontal alignment or reference feature 108) of the object 100, as shown in FIGS. 11 and 12, and the engagement surface 52 of the support portion 50 is oriented horizontally, the reference portion 108 of the object 100 is oriented horizontally (and, the object 100 as a whole, is oriented horizontally assuming proper mounting to the object).

As shown in FIGS. 11 and 12, the object 100 may include an alignment feature 108, such as a frame, with which the alignment projection 54 engages (with the engagement surface 44 potentially engaging the back side of the object 100) to align the orientations of the object component 40 and the object 100, and potentially support the object, at least partially. As shown in FIG. 11, the pointed tip edge 58 of the alignment projection 54 may engage a bottom side or surface, or bottom facing side or surface, of the alignment feature 108 of the object 100. In some such embodiments, the alignment feature 108 may be a frame, such as a top frame portion, of the object 100.

In another embodiment shown in FIG. 12, the alignment projection 54 may extend into a cavity or opening of the object 100 at a back or rear side of the object 100. In such embodiments, the alignment feature 108 may form the cavity, and the alignment projection 54 may extend into the cavity (with the engagement surface 44 potentially engaging the back side of the object 100 of feature 108 thereof) to align the orientations of the object component 40 and the object 100, and potentially support the object, at least partially. For example, as shown in FIG. 12, the object engagement surface 56 (and potentially the pointed tip edge 58) of the alignment projection 54 may engage a bottom side or surface, or bottom facing side or surface, of the alignment feature 108 within the cavity of the object 100. In such embodiments, the alignment feature 108 may be a frame, such as a top frame portion of a "Neilsen" type frame, of the object 100. Further in examples such as that depicted in FIG. 12, it may be desired to limit the extent to which the object component 40 extends upward, and specifically so that it does not extend above object 100 or feature 108, in order to reduce or eliminate viewability of hanging system 10 or components thereof behind object 100. In the example of FIG. 12, mounting portion 42 is configured with a perforation 47 at which mounting portion 42 may be broken off, cut, or the like by a user. Alternatively, mounting portion 42 could be constructed with a height that does not extend above approximately the position of perforation 47, or mounting portion 42 could be eliminated from the object component 40 altogether, in which case the object component 40 includes a retention portion 48 and support portion 50 but lacks a mounting portion 42 or similar feature extending upwardly from support portion 50.

As shown in FIGS. 1-4 and 13-19, the support component 20 may include a mounting portion 22, a channel portion 30, and an intermediate portion 26 that extends between the mounting portion 22 and the channel portion 30.

Figure 19:
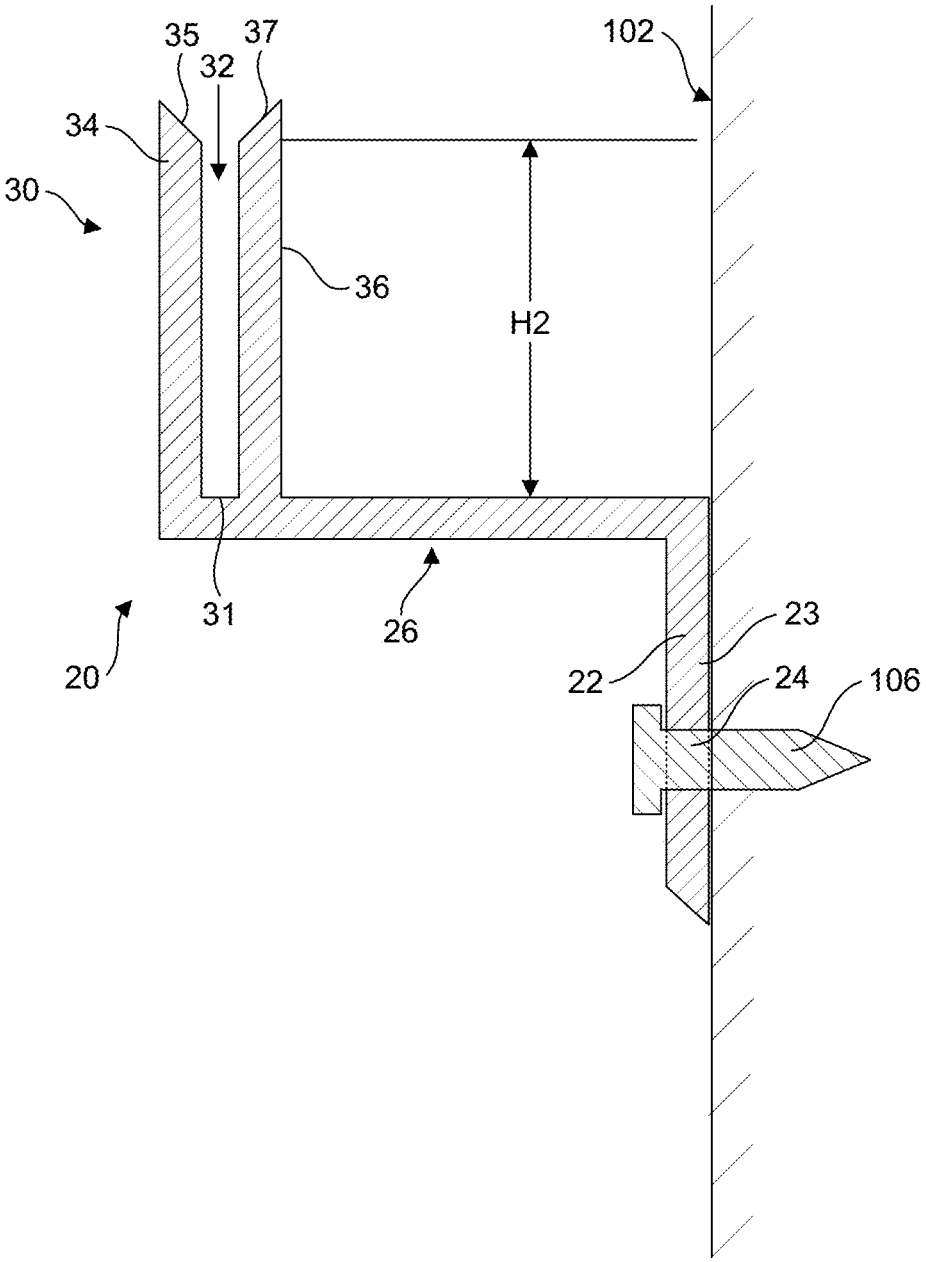
FIG. 19 is a side cross-sectional view of the support component of FIG. 13 coupled with a support structure in accordance with one or more aspects of the present disclosure.

In some embodiments, the mounting portion 22 is configured to engage/abut the support structure 102, such as but not limited to a front or forward-facing surface of the support structure 102. In some embodiments, the mounting portion 22 may include or define a rear or back (rearwardly facing) mounting or support side or surface 23 that is configured to engage a corresponding front (forwardly facing) mounting surface or side portion of the support structure 102, as shown in FIGS. 2 and 19. In the illustrated exemplary embodiment, the support surface 23 of the mounting portion 22 is substantially planar. In some other embodiments (not shown), the support surface 23 of the mounting portion 22 may be non-planar.

As shown in shown FIGS. 1-4, 13-16 and 19, the mounting portion 22 may include a plurality of mounting apertures 24 extending there through from the support surface 23 to an opposing surface of the mounting portion 22, such as a forwardly facing surface of the mounting portion 22. The plurality of mounting apertures 24 may be located at differing locations along the lateral length of the mounting portion 22, and be located at differing heights. The mounting apertures 24 may be configured to allow a fastening or fixation member 106, such as but not limited to a nail or screw, to pass therethrough and into the support structure 102 positioned at or adjacent to the support surface 23 to couple the mounting portion 22 (and thereby the support component 20 itself) and the support structure 102 together, as shown in shown FIGS. 2 and 19. In some other embodiments (not shown), mounting portion 22 may be coupled to the support structure 102 via a fastening mechanism other than at least one fastening member 106 extending through a mounting aperture 24, such as via a touch fastener or an adhesive, for example, at the support surface 23.

As shown in FIGS. 13-16 and 19, the mounting portion 22 may form a bottom portion of the support component 20, and define a free bottom end of the object component 20 along the height direction. In some embodiments, a top end or portion of the mounting portion 22 may abut or be contiguous with the intermediate portion 26, as shown in FIGS. 1-4 and 13-19. The intermediate portion 26 extends forwardly from/of the mounting portion 22 and spaces the channel portion 30 forwardly from the support structure 102 (and the mounting portion 22) when the rear support surface 23 is engaged with the surface of the support structure 102 (and the support component 20 is coupled to the support structure), as shown in FIGS. 2 and 19.

In some embodiments, the intermediate portion 26 may extend substantially linearly forwardly. For example, the intermediate portion 26 may be a substantially planar portion or member, and potentially define top and bottom substantially planar surfaces. The width W1 of the intermediate portion 26 (in the front-back direction), as shown in FIG. 13, may be of any dimension. In some embodiments, to space the object 100 (and object component 40, via the channel portion 30) an effective distance from the support structure 102, the width W1 of the intermediate portion 26 may be at least 0.2, 0.3, 0.4, 0.5, 0.6, 0.7, 0.8, 0.9, 1.0, 1.1, 1.2, 1.3, 1.4, 1.5, 1.6, 1.7, 1.8, 1.9 or 2.0 inches. It is noted that the space behind the object 100, between the object 100 and the support structure 102, provided (at least in part) by the intermediate portion 26 is effective in allowing airflow behind the object and/or allowing structures to be positioned behind and/or pass behind the object 100 between the object 100 and the support structure 102. Further, the forward spacing of the object 100 from the support structure 102, provided (at least in part) by the intermediate portion 26, is effective in providing a visually and/or aesthetically pleasing presentation (or effect) of the object 100, which may appear to be hovering/floating in front of the support structure 102.

In some embodiments, the support component 20 may include a downwardly extending accessory portion or member. The accessory portion may extend from the bottom side of the intermediate portion 26 and/or the channel portion 30, for example. The accessory portion may be spaced forwardly from the mounting portion 22, and define a rear surface that faces the front side of the first mounting portion 22. The accessory portion may be utilized to mount or support an accessory to the support component 20, such as a light emitting device and/or a sound emitting device.

As shown in FIGS. 1-4, 13, 16 and 19, the channel portion 30 of the support component 20 may extend from or be positioned at a forward end of the intermediate portion 26. In some embodiments, at least a portion of the channel portion 30 may extend upwardly from the intermediate portion 26. For example, in the exemplary illustrated embodiment as shown in FIG. 13, a channel bottom portion 31 of the channel portion 30 may extend from (and be contiguous with) the intermediate portion 26. However, in alternative embodiments, the channel bottom portion 31 of the channel portion 30 may be positioned above or below the intermediate portion 26.

As shown in FIGS. 13, 16, 17 and 19, the channel portion 30 may comprise a retention channel 32 formed between front 34 and rear 36 support members that is open or exposed at a top or upper end thereof. The front support member 34 and the rear support member 36 may be spaced apart by (at least) a width T1 that extends in the forward-back direction (i.e., a direction extending between the support structure 102 and the object 100), as explained above to accommodate the retention portion 48. In some embodiments, the front support member 34 and the rear support member 36 may be planar, and be extended or aligned along the lateral direction.

As also discussed above, the retention channel 32 is configured to house the retention portion 48 of the object component 40 therein, such that the retention portion 48 extends into and seats within the retention channel 32. In some embodiments, the retention channel 32 (and potentially the front support member 34 and/or the rear support member 36, or at least their inner surfaces) may extend linearly in the height and/or lateral length directions (e.g., be planar). For example, the front support member 34 and/or the rear support member 36 may define opposing planar side surfaces in the width direction (front to back direction). In some embodiments, the retention channel 32 is substantially planar and laterally extended or elongated.

The total height H2 of the retention channel 32 (see FIGS. 3, 19) may be defined between upper or top end portions or surfaces of the front support member 34 and/or the rear support member 36. For instance, front support member 34 has an upper or top end portion or surface 35 and rear support member 36 has an upper or top end portion or surface 37, as shown in FIGS. 1-4, 13-17 & 19. In some embodiments, the top end portion 35 of the front support member 34 includes or defines a downwardly sloping engagement surface, that engages the engagement surface 52 of the support portion 50 of the object component 40 when the object component 40 (i.e., the retention portion 48) is fully seated within the retention channel 32, as shown in FIGS. 1 and 2. In some such embodiments, the top end portion 35 is configured as an inclined plane, and slopes rearwardly toward the retention channel 32 as it extends downwardly. In some embodiments, the top end portion 35 is configured as a planar beveled surface.

The top end portion 35 of the front support member 34 may act to force the retention portion 48 rearwardly when the engagement surface 52 and the top end portion 35 abut. In such embodiments, when the retention portion 48 is fully seated within the retention channel 32 and the engagement surface 52 is engaged with and supported by the top end portion 35 of the front support member 34, a front side of the rear support member 36 may engage a rear side of the retention portion 48, which may act to maintain engagement of the engagement surface 52 and the top end portion 35 of the front support member 34 depending upon the thickness T2 (FIG. 13) of the retention channel 32 and the thickness T1 (FIG. 5) of the retention portion 48.

In some embodiments, the top end portion 37 of the rear support member 36 includes or defines a downwardly sloping engagement surface. In some such embodiments, the top end portion 37 is configured as an inclined plane, and slopes forwardly toward the retention channel 32 as it extends downwardly. In some embodiments, the top end portion 37 is configured as a planar beveled surface. It is noted that the top end portion 37 of the rear support member 36, and the top end portion 35 of the front support member 34, may act to guide the retention portion 48 into the retention channel 32 upon installation.

In use, the support portion 22 of the support component 20 may be coupled to a support structure 102, as described above, in a laterally level orientation. The support portion 42 of the object component 40 may likewise be coupled to a rear side surface or portion of the object 100 such that the alignment projection 54 engages the alignment feature 108 of the object (e.g., a bottom side or surface of a frame of the object), as described above. The retention portion 48 may then be inserted into the retention channel 32 of the channel portion 30 of the support component 20, and fully seated therein such that the engagement surface 52 engages the top end portion 35 of the front support member 34. In this arrangement, the support component 20 securely physically supports the object component 40 in a laterally level orientation, and thereby physically supports the object 100 in a laterally level orientation, on the support structure 102, as shown in FIG. 2.

It is to be understood that the above description is intended to be illustrative, and not restrictive. For example, the above-described examples (and/or aspects thereof) may be used in combination with each other. For example, a feature, aspect or function of one embodiment or component may be equally or similarly employed in another embodiment or component. In addition, many modifications may be made to adapt a particular situation or material to the teachings of the various examples without departing from their scope. While dimensions and types of materials may be described herein, they are intended to define parameters of some of the various examples, and they are by no means limiting to all examples and are merely exemplary. Many other examples will be apparent to those of skill in the art upon reviewing the above description. The scope of the various examples should, therefore, be determined with reference to the appended claims, along with the full scope of equivalents to which such claims are entitled.

The terminology used herein is for the purpose of describing particular embodiments only and is not intended to be limiting of the inventions disclosed in this disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

As used herein, the terms "comprising," "has," "including," "containing," and grammatical variants thereof encompass the terms "consisting of" and "consisting essentially of" The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed compositions or methods.

Moreover, the terms "first," "second," and "third," etc. are used herein merely as referee labels, and are not intended to impose numerical, structural or other requirements on their objects. Forms of the term "defined" encompass relationships where an element is partially defined as well as relationships where an element is entirely defined.

Any publication cited in this specification are herein incorporated by reference as if each individual publication were specifically and individually indicated to be incorporated by reference herein as though fully set forth. Subject matter incorporated by reference is not considered to be an alternative to any claim limitations, unless otherwise explicitly indicated.

Where one or more ranges and numeral endpoints are referred to throughout this specification, each is intended to be a shorthand format for presenting information, where a range is understood to encompass each discrete point within the range as if the same were fully set forth herein.

Further, the limitations of the following claims are not written in means-plus-function format and are not intended to be interpreted based on 35 U.S.C. § 112, sixth paragraph, unless and until such claim limitations expressly use the phrase "means for" followed by a statement of function cavity of further structure. It is to be understood that not necessarily all such objects or advantages described above may be achieved in accordance with any particular example. Thus, for example, those skilled in the art will recognize that the devices, systems and methods described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of examples, it should be readily understood that the disclosure is not limited to such disclosed examples. Rather, this disclosure can be modified to incorporate any number of variations, alterations, substitutions or equivalent arrangements not heretofore described, but which are commensurate with the spirit and scope of the disclosure. Additionally, while various examples have been described, it is to be understood that aspects of the disclosure may include only one example or some of the described examples. Also, while some disclosure are described as having a certain number of elements, it will be understood that the examples can be practiced with less than or greater than the certain number of elements. While several aspects and embodiments of the present inventions have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the disclosure and inventions.

What is claimed is:

1. A system for hanging an object on a support structure, comprising:

a support component configured to couple to the support structure, the support component comprising:

a first mounting portion comprising a rear support surface configured to engage a surface of the support structure;

a channel portion comprising a retention channel formed between a front support member and a rear support member, the retention channel being open at an upper end; and an intermediate portion that extends between the first mounting portion and the channel portion that positions the channel portion forwardly of the first mounting portion and spaces the channel portion forwardly from the support structure when the rear support surface is engaged with the surface of the support structure and the support component is coupled to the support structure; and an object component configured to couple to a back side of the object, the object component comprising:

a second mounting portion configured to engage a surface or an alignment feature of the object;

a retention portion defining a free bottom end and configured to seat within the retention channel of the support component; and a support portion between the second mounting portion and the retention portion, the support portion comprising an engagement surface;

wherein the support component and the object component are configured such that when the retention portion is seated within the retention channel, the engagement surface is engaged with a top end portion of the front support member such that the support component physically supports the object component.

2. The system of claim 1, wherein the support component and the object component are configured such that when the retention portion is seated within the retention channel and the engagement surface is engaged with, and supported by, the top end portion of the front support member, the free bottom end of the retention portion is spaced from a bottom of the retention channel.

3. The system of claim 1, wherein the engagement surface of the support portion is a first engagement surface, and wherein the top end portion of the front support member comprises a second engagement surface configured to engage with the first engagement surface when the retention portion is seated within the retention channel.

4. The system of claim 3, wherein the first engagement surface is a first downwardly sloping engagement surface, and wherein the second engagement surface is a second downwardly sloping engagement surface.

5. The system of claim 4, wherein the second engagement surface is sloped downwardly toward the retention channel, and wherein the first engagement surface is sloped to conform to the second engagement surface.

6. The system of claim 3, wherein the first engagement surface is positioned on a front side of the object component.

7. The system of claim 1, wherein the support component and the object component are configured such that when the retention portion is seated within the retention channel and the engagement surface is engaged with, and supported by, the top end portion of the front support member, a front side of the rear support member engages a rear side of the retention portion such that the engagement of the engagement surface and the top end portion of the front support member is maintained.

8. The system of claim 1, wherein the support component further comprises an accessory portion that extends downwardly from a bottom portion of the channel portion and is spaced forwardly from a front side of the first mounting portion, the accessory portion defining a rear surface that faces the front side of the first mounting portion.

9. The system of claim 1, wherein a top end portion of the rear support member comprises a guide surface that is sloped downwardly toward the retention channel.

10. The system of claim 9, wherein the guide surface of the rear support member is a planar beveled surface.

11. The system of claim 1, wherein the object component further comprises a front alignment projection that extends forwardly from a front side of the object component and is configured to engage the alignment feature of the object.

12. The system of claim 1, wherein the retention portion is positioned rearwardly of the second mounting portion.

13. The system of claim 1, wherein the retention portion extends laterally and is substantially planar, and the retention channel extends laterally and is substantially planar.

14. The system of claim 1, wherein the second mounting portion comprises a front support surface that extends laterally and is substantially planar, and the rear support surface extends laterally and is substantially planar.

15. The system of claim 1, wherein the first mounting portion further comprises a plurality of mounting apertures extending therethrough between the rear support surface and a front side of the first mounting portion.

16. The system of claim 1, wherein the second mounting portion further comprises a plurality of mounting apertures extending therethrough between a front support surface and a rear surface of the second mounting portion.

17. The system of claim 1, wherein the second mounting portion comprises a planar front support surface configured to engage the surface of the object.

18. A method of hanging an object on a support structure, comprising:

obtaining an object hanging system comprising:

(i) a support component comprising:

a first mounting portion comprising a rear support surface;

a channel portion comprising a retention channel formed between front support member and a rear support member, the retention channel being open at an upper end; and an intermediate portion that extends between the first mounting portion and the channel portion that positions the channel portion forwardly of the first mounting portion; and (ii) an object component comprising:

a second mounting portion;

a retention portion defining a free bottom end; and a support portion between the second mounting portion and the retention portion, the support portion comprising an engagement surface;

affixing the first mounting portion to the support structure with the rear support surface in engagement with a surface of the support structure such that the channel portion is positioned forwardly of the surface of the support structure;

affixing the second mounting portion to the object with a front support surface of the second mounting portion aligned and engaged with a surface or an alignment feature of the object; and positioning the retention portion within the retention channel and engaging the engagement surface with a top end portion of the front support member such that the support component physical supports the object component and, thereby, the object is supported by the support structure.

19. The method of claim 18, wherein the affixing the second mounting portion to the object comprises engaging the front surface with a back surface or an edge of the alignment feature of the object.

20. The method of claim 18, wherein the object is a frame or framed object.

* * * * *